US006300614B1

(12) United States Patent
Petlan

(10) Patent No.: US 6,300,614 B1
(45) Date of Patent: Oct. 9, 2001

(54) COMMUNICATION SYSTEM USING GRAVITATIONAL WAVES

(76) Inventor: Jiri Joseph Petlan, Apt. 305 - 110 East Kings Road, North Vancouver British Columbia (CA)

( * ) Notice: Subject to any disclaimer, the term of this patent is extended or adjusted under 35 U.S.C. 154(b) by 0 days.

(21) Appl. No.: 09/050,014

(22) Filed: Mar. 30, 1998

(51) Int. Cl.[7] ..... H01J 40/14

(52) U.S. Cl. ..... 250/214 LS; 73/382 G; 250/214.1

(58) Field of Search ..... 250/214 LS, 214.1, 250/214 R, 214 SW, 214 DC, 222.2; 73/382 R, 382 G, 32 R; 359/117, 124, 138; 505/182, 202

(56) References Cited

U.S. PATENT DOCUMENTS 3,722,286 * 3/1973 Weber ..... 73/382

* cited by examiner

*Primary Examiner*—Que T. Le
(74) *Attorney, Agent, or Firm*—Oyen Wiggs Green & Muta

(57) ABSTRACT

A method and apparatus for communication using gravitational waves is disclosed. The system utilizes a resonant frequency set up between identical masses to transmit information. The communication system uses two pieces of superconducting material, identical in size, mass and shape; means to modify the density of the first piece of superconducting material at a variable frequency; and detection means for sensing the effect of gravitational wave pulses on said second piece of superconducting material.

22 Claims, 4 Drawing Sheets

COMMUNICATION SYSTEM USING GRAVITATIONAL WAVES

TECHNICAL FIELD

The invention relates to the field of communication devices, and more particularly to devices which communicate utilizing gravitational waves or radiation.

BACKGROUND ART

Einstein's General Theory of Relativity predicts the existence of gravitational waves or radiation which are produced by a change in the distribution of matter. Such waves theoretically travel at the speed of light. The existence of such waves has been experimentally confirmed and operating gravitational radiation detectors of various types have been designed, for example the low-temperature gravitational radiation detectors at the High Energy Physics Laboratory, Stanford University. Such radiation, however, has not to date been utilized as a communication medium.

DISCLOSURE OF INVENTION

The present invention utilizes a resonant frequency set up between identical masses to transmit information by gravitational wave pulses.

The invention provides a communication system comprising: i) first and second pieces of superconducting material, identical in size, mass and shape, separated by a given distance D; ii) means to modify the density of the first piece of superconducting material at a variable frequency; and iii) detection means for sensing the effect of gravitational wave pulses on said second piece of superconducting material.

The invention further provides a method of communication comprising: i) creating a resonant gravitational field by providing first and second pieces of superconducting material, identical in size, mass and shape, separated by a given distance D; ii) generating pulses in the resonant gravitational field by modifying the density of the first piece of superconducting material at a variable frequency; and iii) detecting the effect of said gravitational wave pulses on the second piece of superconducting material.

BRIEF DESCRIPTION OF DRAWINGS

In drawings which illustrate a preferred embodiment of the invention.

BEST MODE(S) FOR CARRYING OUT THE INVENTION

Figure 1:
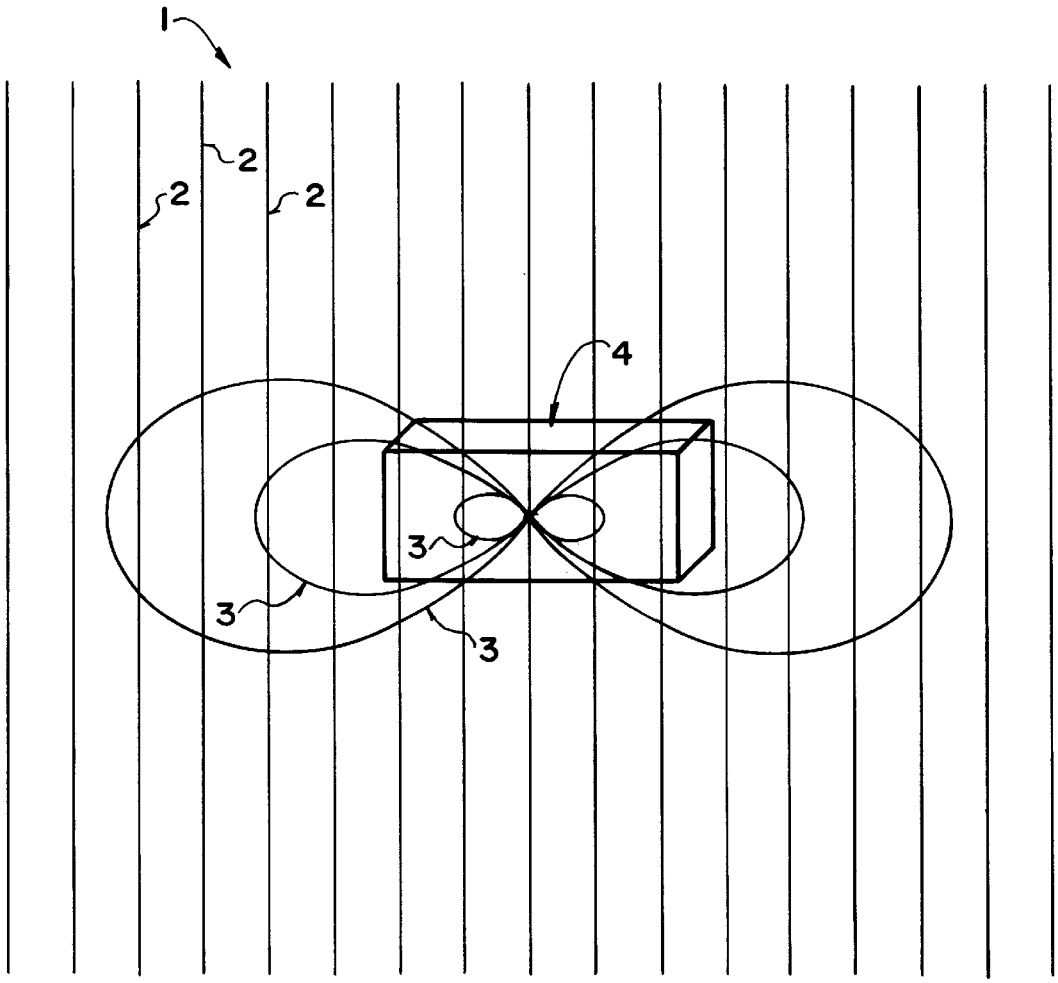
FIG. 1 illustrates a piece of superconducting material and related gravitational fields.
Figure 2:
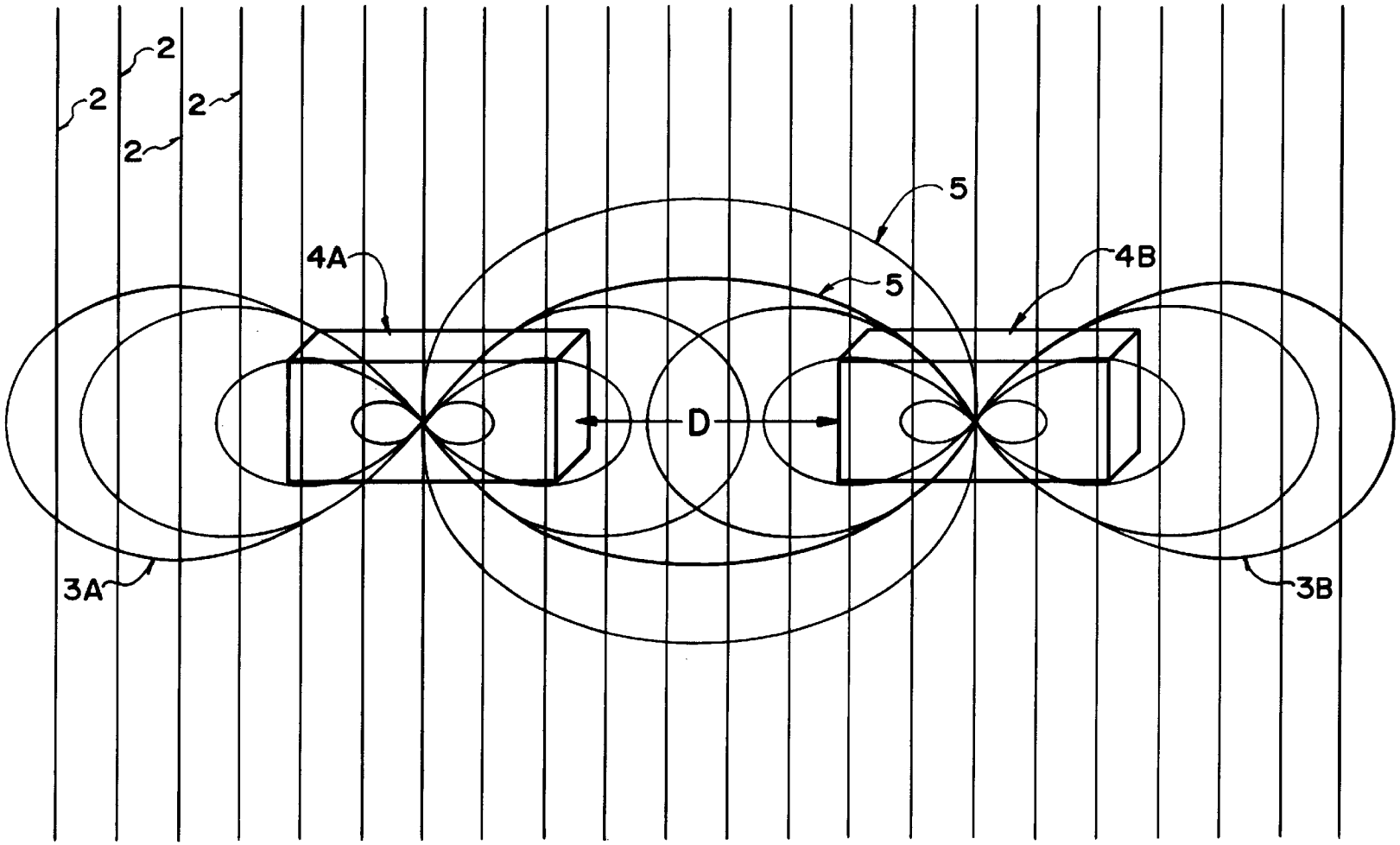
FIG. 2 illustrates two identical pieces of superconducting material forming a gravitational resonance field.

With reference to FIG. 1, a piece of superconducting material 4, having its own gravitational field 3 is shown in isolation in the universal gravitational field 1. FIG. 2 illustrates two pieces of superconducting material 4, identical in size, mass and shape, which are separated by a distance D. Preferably the superconducting material is a composition of 49.5% Rhodium and 49.5% iridium with 1% copper or yttrium doping, and are maintained at a temperature of −45 degrees C., although materials which are superconductive at room temperature would also be useful. Each piece of material 4A, 4B has an associated gravitational field 3A, 3B. The interaction of the gravitational fields 3A, 3B of the two identical pieces 4A, 4B combine to form a resonant gravitational field 5.

Figure 3:
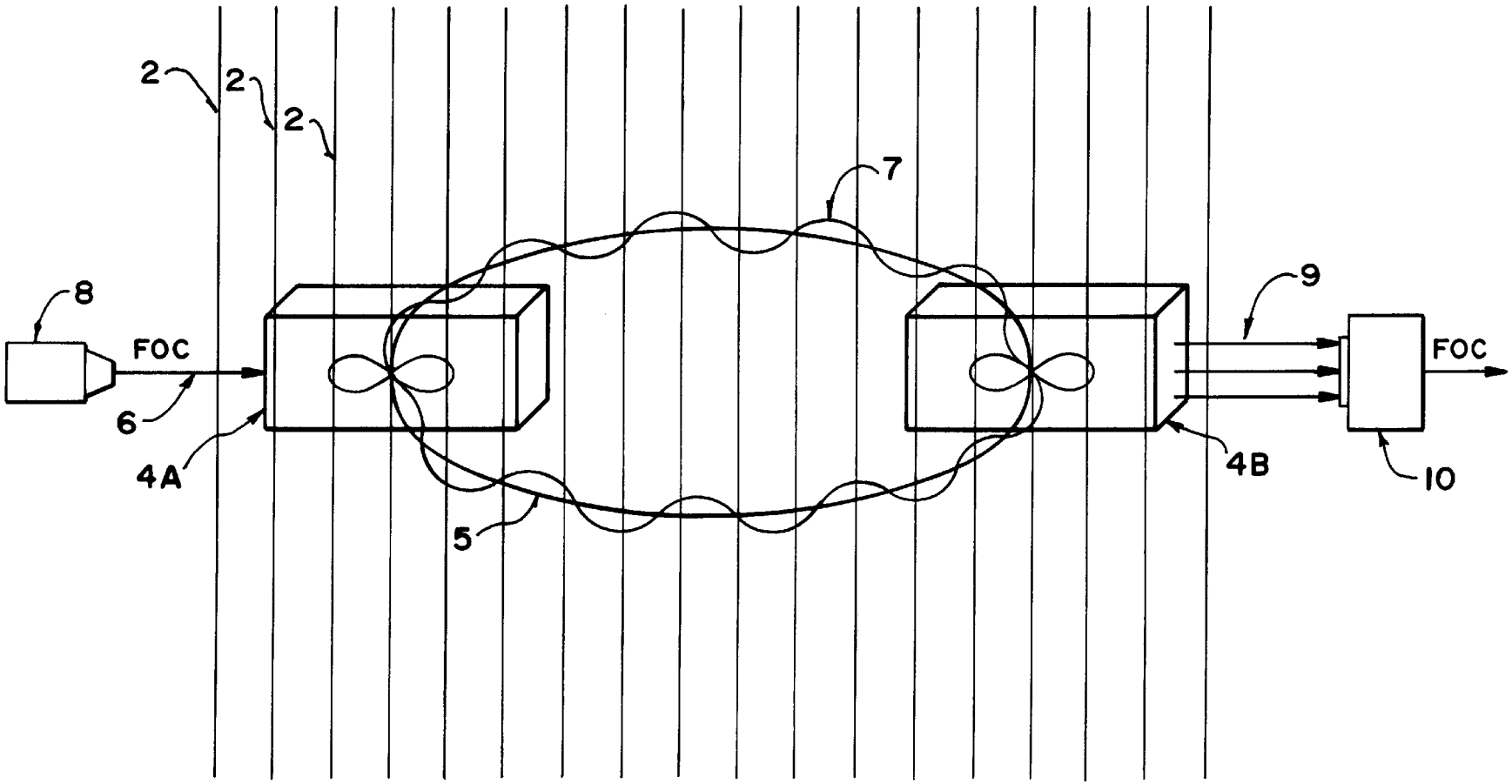
FIG. 3 illustrates the communications circuit according to the invention.

As shown in FIG. 3, gravitational field 5 can be used to transmit or receive information in the form of gravitational pulses 7. A laser 8 impinges pulses of light signals against the end of the piece 4A of superconducting material via fibre optic cable 6, which causes a modulation of the field 5 at the frequency of the laser pulses. Alternatively, a laser-like particle beam emitter could be used instead of a laser to modify the density of piece 4A and thereby modify field 5. Laser 8 can emit pulses to provide either a digital or analog signal. The modulation of field 5 by laser 8 causes a corresponding reaction in piece 4B which can be sensed in a number of ways. For example the gravitational wave pulses can be detected by detector 10 in the same way as existing gravitational wave detectors used, for example, at the United States Interferometer Gravitational Wave Observatory. Or detector 10 can be a photocell used to detect photons 9 or other particles emitted by piece 4B. The digital or analog signal which is detected by detector 10 can then be converted to another form of signal, whether electromagnetic, fibre optic, microwave etc.

Figure 4:
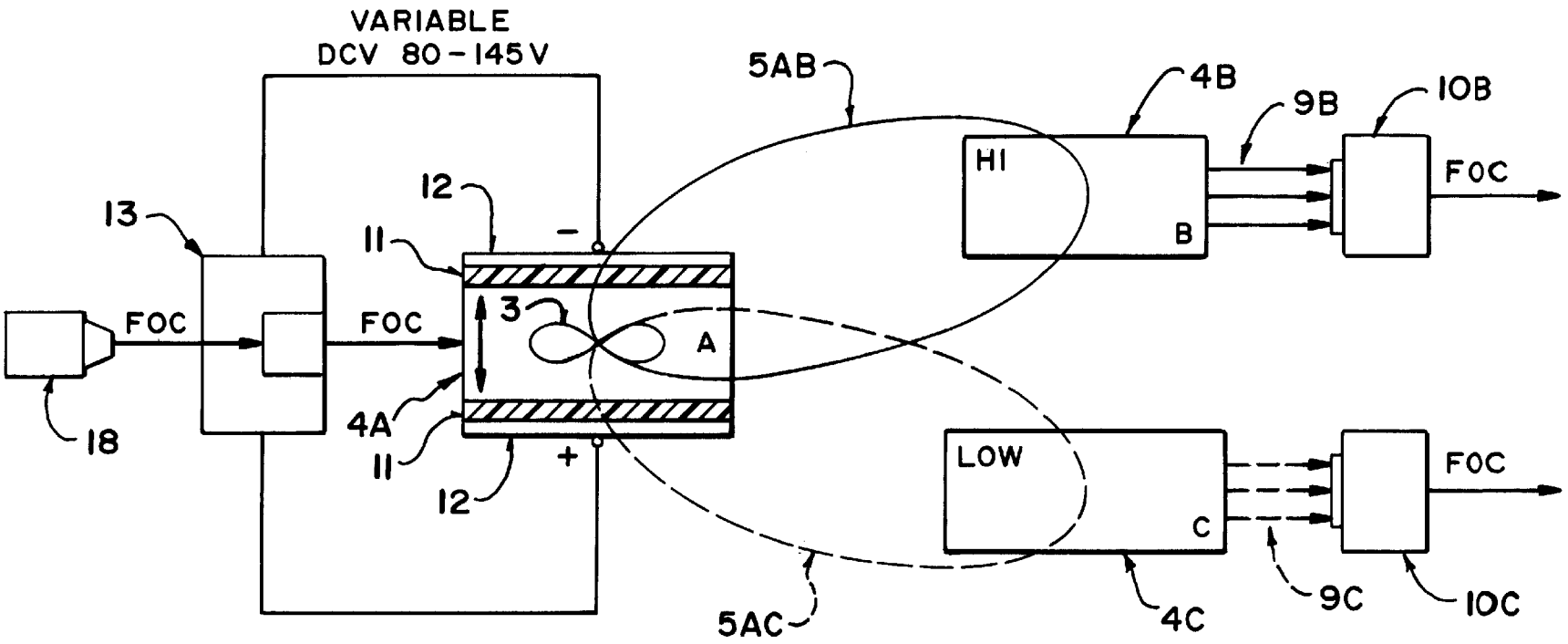
FIG. 4 illustrates a switch constructed according to the invention.

The transmission of information by gravitational wave pulses is useful for long distances D, for high speed, rapid switching and low distortion of either digital or analog signals. For example, transmission of information by gravitational wave pulses according to the invention can be used for long distance wireless communication, and for switching or routers as shown in FIG. 4. which illustrates a superconductor resonance switch. A laser or laser-like signal is generated by a signal generator 18. The signal consists of a code of destination that is detected by a convertor variac system 13. The convertor variac system determines from the signal how high to adjust the DCV potential that operates from 80 volts to 145 volts DC on the electrodes 12. The electrodes 12 are separated from the superconductive material 4A by a dielectric 11 such as Bakelite™. The potential difference created between electrodes 12 compresses the gravitational field 3 of piece 4A so that it becomes resonant with either a higher or lower frequency, thus coupling the field 3 to either a smaller piece 4B or larger piece 4C of superconductive material. Once coupled in resonance to either piece 4B or 4C, the transmission of information between the two resonant pieces of superconductive material can be carried out as in FIG. 3. Thus the device can function as a switch to change the path of the signal from 4A–4B to 4A–4C and vice versa by applying a potential to electrodes 12.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A communication system comprising:

i) first and second pieces of superconducting material, identical in size, mass and shape, separated by a given distance D;

ii) means to modify the density of said first piece of superconducting material at a variable frequency; and iii) detection means for sensing the effect of gravitational wave pulses on said second piece of superconducting material.

2. The communication system of claim 1 wherein said superconducting material is a composition of 49.5% Rhodium and 49.5% iridium with 1% copper or yttrium doping.

3. The communication system of claim 1 wherein said superconducting material is maintained at a temperature of −45 degrees C. or less.

4. The communication system of claim 1 wherein said superconducting material is maintained at room temperature.

5. The communication system of claim 1 wherein said means to modify the density of said first piece of superconducting material comprises a laser adapted to impinge pulses of light signals against the end of said first piece of superconducting material.

6. The communication system of claim 1 wherein said means to modify the density of said first piece of superconducting material comprises a particle or microwave emitter.

7. The communication system of claim 1 wherein said means to modify the density of said first piece of superconducting material provides a variable digital or analog signal.

8. The communication system of claim 1 wherein said detection means comprises a gravitational wave detector.

9. The communication system of claim 1 wherein said detection means comprises a photocell to detect photons or other particles emitted by said second piece of superconducting material.

10. The communication system of claim 1 further comprising means for converting said digital or analog signal to an electromagnetic, optical or microwave signal.

11. A switch comprising:

i) first, second and third pieces of superconducting material;

ii) means to modify the density of said first piece of superconducting material at a variable frequency;

iii) detection means for sensing the effect of gravitational wave pulses on said second and third pieces of superconducting material;

iv) means to selectively modify the size and shape of said first piece of superconducting material to be identical in size and shape with either said second or third piece of superconducting material.

12. The switch of claim 11 wherein said superconducting material is a composition of 49.5% Rhodium and 49.5% iridium with 1% copper or yttrium doping.

13. The switch of claim 11 wherein said superconducting material is maintained at a temperature of −45 degrees C.

14. The switch of claim 11 wherein said superconducting material is maintained at room temperature.

15. The switch of claim 11 wherein said means to modify the density of said first piece of superconducting material comprises a laser adapted to impinge pulses of light signals against the end of said first piece of superconducting material.

16. The switch of claim 11 wherein said means to modify the density of said first piece of superconducting material comprises a laser-like particle beam emitter.

17. The switch of claim 11 wherein said means to modify the density of said first piece of superconducting material provides a variable digital or analog signal.

18. The communication system of claim 1 wherein said detection means comprises a gravitational wave detector.

19. The switch of claim 11 wherein said detection means comprises a photocell to detect photons or other particles emitted by said second piece of superconducting material.

20. The switch of claim 11 further comprising means for converting said digital or analog signal to an electromagnetic, optical or microwave signal.

21. A method of communication of information between first and second locations, comprising:

i) generating pulses in a gravitational field at a first location, said pulses representing said information;

ii) detecting the effect of said gravitational pulses on a piece of matter at said second location; and iii) determining said information from said detected effect.

22. The method of claim 21 wherein said gravitational pulses are created by i) creating a resonant gravitational field by providing first and second pieces of superconducting material, identical in size, mass and shape, separated by a given distance D; and ii) generating pulses in said resonant gravitational field by modifying the density of said first piece of superconducting material at a variable frequency;

and the effect of said gravitational wave pulses is detected on said second piece of superconducting material.

* * * * *